US012018420B2

(12) United States Patent
Choi et al.

(10) Patent No.: US 12,018,420 B2
(45) Date of Patent: Jun. 25, 2024

(54) LAUNDRY TREATING APPARATUS

(71) Applicant: LG Electronics Inc., Seoul (KR)

(72) Inventors: Kyoungmin Choi, Seoul (KR); Jihong Lee, Seoul (KR); Kwanwoong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 330 days.

(21) Appl. No.: 17/287,348

(22) PCT Filed: Oct. 24, 2019

(86) PCT No.: PCT/KR2019/014034
§ 371 (c)(1),
(2) Date: Apr. 21, 2021

(87) PCT Pub. No.: WO2020/085807
PCT Pub. Date: Apr. 30, 2020

(65) Prior Publication Data

US 2021/0381148 A1 Dec. 9, 2021

(30) Foreign Application Priority Data

Oct. 24, 2018 (KR) ..... 10-2018-0127574

(51) Int. Cl.
*D06F 31/00* (2006.01)
*D06F 23/02* (2006.01)
(Continued)

(52) U.S. Cl.
CPC ..... *D06F 31/00* (2013.01); *D06F 23/025* (2013.01); *D06F 23/04* (2013.01); *D06F 39/12* (2013.01)

(58) Field of Classification Search
CPC ..... D06F 31/00; D06F 23/025; D06F 23/04; D06F 39/12; D06F 29/00; D06F 37/26
(Continued)

(56) References Cited

U.S. PATENT DOCUMENTS 8,341,981 B2 * 1/2013 Kim ..... D06F 39/125 68/3 R
2005/0275325 A1 * 12/2005 Yang ..... D06F 29/005 312/330.1
(Continued)

FOREIGN PATENT DOCUMENTS

CN 104846597 8/2015
CN 105624984 A 6/2016
(Continued)

OTHER PUBLICATIONS

Yang, "Box for washing machine", Oct. 2010, KR-20100108899-A—machine translation (Year: 2010).*
(Continued)

*Primary Examiner* — David G Cormier
*Assistant Examiner* — Thomas Bucci
(74) *Attorney, Agent, or Firm* — Birch, Stewart, Kolasch & Birch, LLP

(57) ABSTRACT

A laundry treating apparatus includes a cabinet with an outlet, a drawer drawn out from the outlet, and a tub inside the drawer, providing a space for storing water and having an inlet on its upper surface. A drum rotatably mounted inside the tub includes an inlet on an upper surface for receiving laundry inside of the drum. A cabinet includes a first frame made at least in part from metal and including a first outlet, a second frame made at least in part from metal, spaced apart from the first frame along a moving direction of the drawer, and including a second outlet, a base panel made of a nonmetal lighter than metal, fixed to the first and
(Continued)

second frames, and forming a bottom surface of the cabinet, and a metal cover fixed to the first and second frames and forming an upper surface and both sides of the cabinet.

14 Claims, 6 Drawing Sheets

(51) Int. Cl.
*D06F 23/04* (2006.01)
*D06F 39/12* (2006.01)

(58) Field of Classification Search
USPC ..... 68/27
See application file for complete search history.

(56) References Cited

U.S. PATENT DOCUMENTS

2007/0151120 A1* 7/2007 Tomasi ..... D06F 58/10 38/14
2009/0007602 A1* 1/2009 Woo ..... D06F 39/10 68/208
2010/0005681 A1* 1/2010 Jo ..... D06F 39/125 34/215
2010/0089099 A1* 4/2010 Han ..... D06F 39/12 68/13 R
2011/0265524 A1* 11/2011 Kim ..... D06F 39/08 68/13 R
2011/0298338 A1* 12/2011 Kim ..... D06F 29/00 312/109
2014/0053612 A1* 2/2014 Son ..... D06F 29/00 68/28
2015/0345071 A1* 12/2015 Lee ..... D06F 29/00 68/27
2017/0088998 A1* 3/2017 Lee ..... D06F 37/12

FOREIGN PATENT DOCUMENTS

EP 2063012 5/2009
IT TO20 110 380 A1 11/2012
KR 10-0866461 10/2008
KR 10-2010-0108899 10/2010
KR 10-2010-0108899 A 10/2010
KR 20100108899 A * 10/2010
WO WO2012/150539 A2 11/2012

OTHER PUBLICATIONS

International Search Report for International Application No. PCT/KR2019/014034 dated Feb. 13, 2020. (10 pages).

* cited by examiner

LAUNDRY TREATING APPARATUS

CROSS-REFERENCE TO RELATED APPLICATIONS

This is a U.S. National Stage Application under 35 U.S.C. § 371 of International Patent Application No. PCT/KR2019/014034, filed Oct. 24, 2019, which claims the benefit of priority of Korean Patent Application No. 10-2018-0127574, filed Oct. 24, 2018; all of which are incorporated herein in their entireties by reference.

TECHNICAL FIELD

The present disclosure relates to a laundry treating apparatus.

BACKGROUND

Generally, a laundry treating apparatus includes an apparatus for washing laundry, an apparatus for drying laundry, and an apparatus for selectively performing washing and drying laundry.

In case of a front loading type laundry treating apparatus (drum washing machine) in which laundry is loaded at the front, since an inlet provided to load laundry into the laundry treating apparatus is formed at a position lower than a waist of a user, an inconvenience exists in that the user should bend his/her back to load laundry into the laundry treating apparatus when inserting or drawing out laundry into or from the laundry treating apparatus. In order to solve this inconvenience, a drawer type support is added below the front loading type laundry treating apparatus of the related art to enhance a height of the inlet.

Moreover, in the laundry treating apparatus of the related art, the drawer type support could perform washing or drying of laundry as well as serve as a means for supporting a bottom surface of the front loading type laundry treating apparatus. The drawer type laundry treating apparatus is provided to include a cabinet, a drawer drawn out from the cabinet, a tub provided inside the drawer, storing water therein, and a drum rotatably provided inside the tub, storing laundry therein. In the drawer type laundry treating apparatus having the aforementioned structure, since the cabinet includes a frame made of a metal material and a metal plate fixed to the frame, problems occur in that the laundry treating apparatus has a heavy weight, needs much manufacturing cost, and needs much time for coupling between components made of metal.

SUMMARY

Technical Problem

An object of the present disclosure is to provide a drawer type laundry treating apparatus capable of performing washing or drying of laundry.

Another object of the present disclosure is to provide a drawer type laundry treating apparatus capable of minimizing a weight and a manufacturing cost of a cabinet.

Another object of the present disclosure is to provide a drawer type laundry treating apparatus capable of reducing an assembly time.

Technical Solution

To achieve the above objects of the present disclosure, a laundry treating apparatus according to the present disclosure comprises a cabinet provided with an outlet; a drawer drawn out from the cabinet through the outlet; a tub provided inside the drawer to provide a space in which water is stored, having an inlet on its upper surface; a drawer provided on the upper surface of the drawer or an upper surface of the tub, opening or closing the inlet; a drum rotatably provided inside the tub, storing laundry therein; and a drum inlet provided on an upper surface of the drum, allowing laundry supplied to the inlet to enter the inside of the drum, wherein the cabinet includes a first frame provided with a first outlet communication hole communicated with the outlet, at least a part of the first frame being made of a metal material; a second frame provided to be spaced apart from the first frame along a moving direction of the drawer, having a second outlet communication hole communicated with the outlet, at least a part of the second frame being made of a metal material; a base panel fixed to the first frame and the second frame, forming a bottom surface of the cabinet, and made of a nonmetal material lighter than metal; and a cover fixed to the first frame and the second frame, forming an upper surface and both sides of the cabinet, and made of a metal material.

The base panel may be made of a plastic material.

The laundry treating apparatus may further comprise a first support and a second support in the base panel along a direction where the drawer is drawn out and spaced apart from each other at an interval longer than a width of the drawer; a first fixed body fixed to the first support; a first detachable body having one end fixed to the drawer and the other end detachably coupled to the first fixed body; a second fixed body fixed to the second support; and a second detachable body having one end fixed to the drawer and the other end detachably coupled to the second fixed body.

The base panel, the first support and the second support may be provided in one body through injection molding.

The laundry treating apparatus may further comprises a stator provided on a bottom surface of the tub, generating a rotating field; a rotor rotated by the rotating field; a rotary shaft provided to pass through the bottom surface of the tub, connecting the rotor with a bottom surface of the drum; and a panel through hole provided to pass through the base panel, allowing the air to the inside of the cabinet.

The first frame may include a first frame body of a bar shape provided to form a bottom surface of the first frame, supporting a lower surface of the base panel, and made of a metal material; a first frame first side body of a metal material extended from one end of the first frame body along a height direction of the drawer; a first frame second side body of a metal material extended from the other end of the first frame body along the height direction of the drawer; and a first frame upper body provided to connect the first frame first side body with the first frame second side body, forming an upper surface of the first frame, and made of a nonmetal material lighter than metal, and the second frame may include a second frame body of a bar shape provided to form a bottom surface of the second frame, supporting the lower surface of the base panel, and made of a metal material; a second frame second side body of a metal material extended from one end of the second frame body along the height direction of the drawer; a second frame second side body of a metal material extended from the other end of the second frame body along the height direction of the drawer; and a second frame upper body provided to connect the second frame first side body with the second frame second side body, forming an upper surface of the second frame, and made of a nonmetal material.

The first frame upper body and the second frame upper body may be made of a plastic material.

The first frame body, the first frame first side body and the first frame second side body may be provided such that one metal is bent in a U shape through press molding, and the second frame body, the second frame first side body and the second frame second side body may be provided such that one metal is bent in a U shape through press molding.

The laundry treating apparatus may further comprise a first bracket having one end fixed to the first frame body and the other end fixed to the first frame first side body; a second bracket having one end fixed to the first frame body and the other end fixed to the first frame second side body; a third bracket having one end fixed to the second frame body and the other end fixed to the second frame first side body; and a fourth bracket having one end fixed to the second frame body and the other end fixed to the second frame second side body.

The laundry treating apparatus may further comprise a second cabinet located on the cabinet; a second drum rotatably provided inside the second cabinet, providing a space in which laundry is stored; a first front leg and a second front leg provided to correspond to the first frame upper body in a space provided by a bottom surface of the second cabinet; a first rear leg and a second rear leg provided to correspond to the second frame upper body in the space provided by the bottom surface of the second cabinet; a first front leg accommodating unit provided in the first frame upper body to pass through the upper surface of the cabinet, providing a space in which the first front leg is accommodated; a second front leg accommodating unit provided in the first frame upper body to pass through the upper surface of the cabinet, providing a space in which the second front leg is accommodated; a first rear leg accommodating unit provided in the second frame upper body to pass through the upper surface of the cabinet, providing a space in which the first rear leg is accommodated; and a second rear leg accommodating unit provided in the second frame upper body to pass through the upper surface of the cabinet, providing a space in which the second rear leg is accommodated.

The laundry treating apparatus may further comprise a first front extension body extended from the first frame first side body toward the first frame second side body; a second front extension body extended from the first frame second side body toward the first frame first side body; a first rear extension body extended from the second frame first side body toward the second frame second side body; a second rear extension body extended from the second frame second side body toward the second frame first side body; a first front connection plate provided in the first front extension body and provided to pass through the first frame upper body and the upper surface of the first cabinet; a second front connection plate provided in the second front extension body and provided to pass through the first frame upper body and the upper surface of the first cabinet; a first rear connection plate provided in the first rear extension body and provided to pass through the second frame upper body and the upper surface of the first cabinet; a first front joint plate provided on the bottom surface of the second cabinet and jointed to the first front connection plate; a second front joint plate provided on the bottom surface of the second cabinet and jointed to the second front connection plate; a first rear joint plate provided on the bottom surface of the second cabinet and jointed to the first rear connection plate; and a second rear joint plate provided on the bottom surface of the second cabinet and jointed to the second rear connection plate.

The first frame body, the first frame first side body, the first frame second side body, the first front extension body, and the second front extension body may be provided such that one metal is bent in a U shape through press molding, and the second frame body, the second frame first side body, the second frame second side body, the first rear extension body, and the second rear extension body may be provided such that one metal is bent in a U shape through press molding.

The laundry treating apparatus may further comprise a first upper bracket having one end fixed to the first frame first side body and the other end fixed to the first front extension body; a second upper bracket having one end fixed to the first frame second side body and the other end fixed to the second front extension body; a third upper bracket having one end fixed to the second frame first side body and the other end fixed to the first rear extension body; and a fourth upper bracket having one end fixed to the second frame second side body and the other end fixed to the second rear extension body.

The laundry treating apparatus may further comprise a third front extension body extended from the first frame first side body toward the second frame first side body; a fourth front extension body extended from the first frame second side body toward the second frame second side body; a third rear extension body extended from the second frame first side body toward the first frame first side body; a fourth rear extension body extended from the second frame second side body toward the first frame second side body; a first left connection plate provided in the third front extension body and provided to pass through the first frame upper body and the upper surface of the cabinet; a first right connection plate provided in the fourth front extension body and provided to pass through the first frame upper body and the upper surface of the cabinet; a second left connection plate provided in the third rear extension body and provided to pass through the second frame upper body and the upper surface of the cabinet; a second right connection plate provided in the fourth rear extension body and provided to pass through the second frame upper body and the upper surface of the cabinet; a first left joint plate provided on the bottom surface of the second cabinet and jointed to the first left connection plate; a first right joint plate provided on the bottom surface of the second cabinet and jointed to the first right connection plate; a second left joint plate provided on the bottom surface of the second cabinet and jointed to the second left connection plate; and a second right joint plate provided on the bottom surface of the second cabinet and jointed to the second right connection plate.

Advantageous Effects

According to the present disclosure, a drawer type laundry treating apparatus capable of performing washing or drying of laundry may be provided.

Also, according to the present disclosure, a drawer type laundry treating apparatus capable of minimizing a weight and a manufacturing cost of a cabinet may be provided.

Also, according to the present disclosure, a drawer type laundry treating apparatus capable of reducing an assembly time may be provided.

DETAILED DESCRIPTION

Hereinafter, preferred embodiments of the present disclosure will be described in detail with reference to the accompanying drawings.

Figure 1:
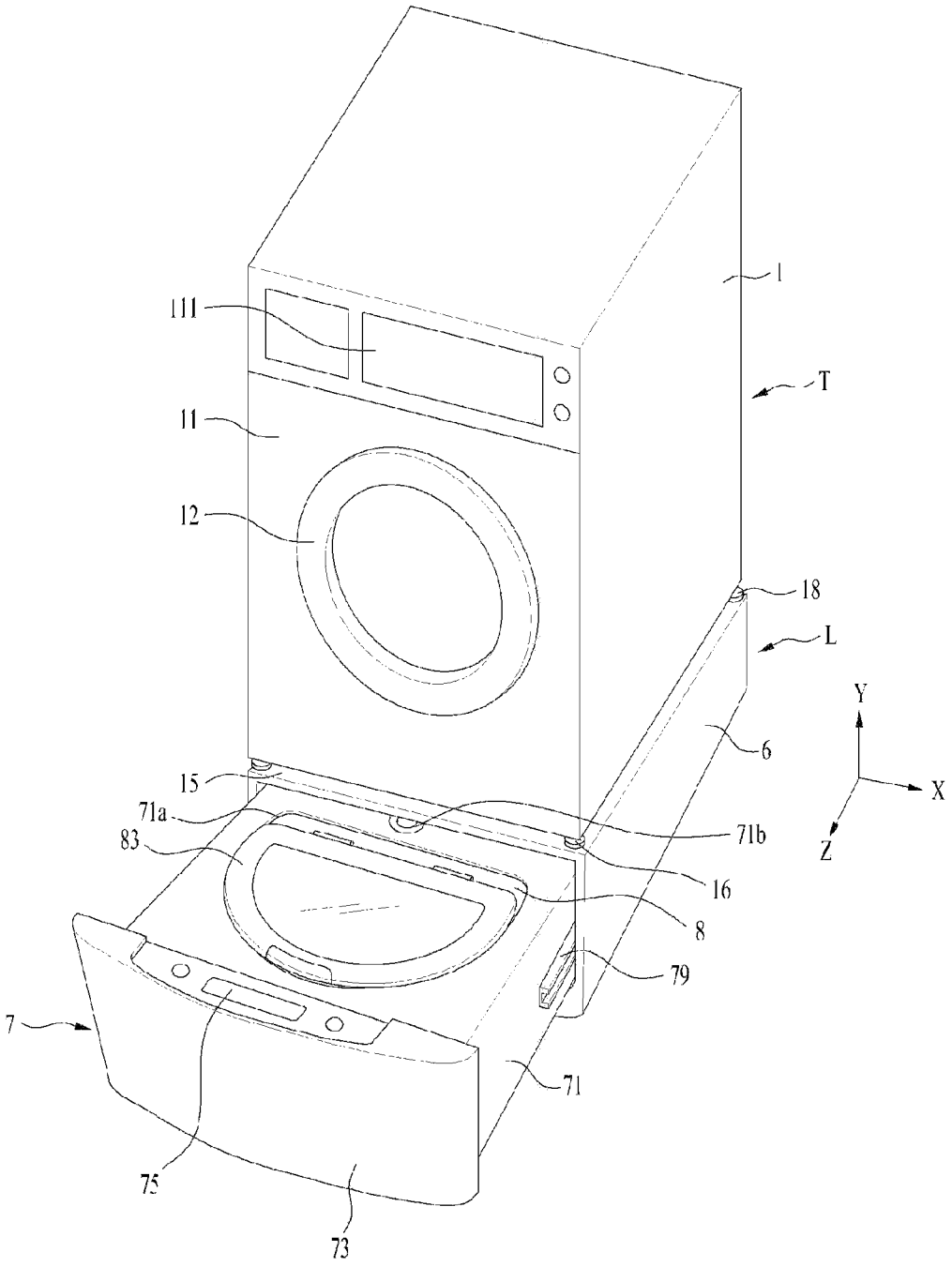
FIGS. 1 and 2 illustrate examples of a laundry treating apparatus.

A laundry treating apparatus may be provided with only a first treating apparatus L that is a drawer type laundry treating apparatus, or may be provided with the first treating apparatus L and a second treating apparatus T arranged on the first treating apparatus. FIG. 1 illustrates that the laundry treating apparatus 100 is provided with both a first treating apparatus L and a second treating apparatus T as an example.

The first treating apparatus L is provided to include a cabinet 6 (first cabinet), a drawer drawn out from the first cabinet, a tub 8 (first tub) provided in the drawer, providing a space where water is stored, and a drum 9 (first drum) provided inside the first tub 8, storing laundry therein.

Figure 2:
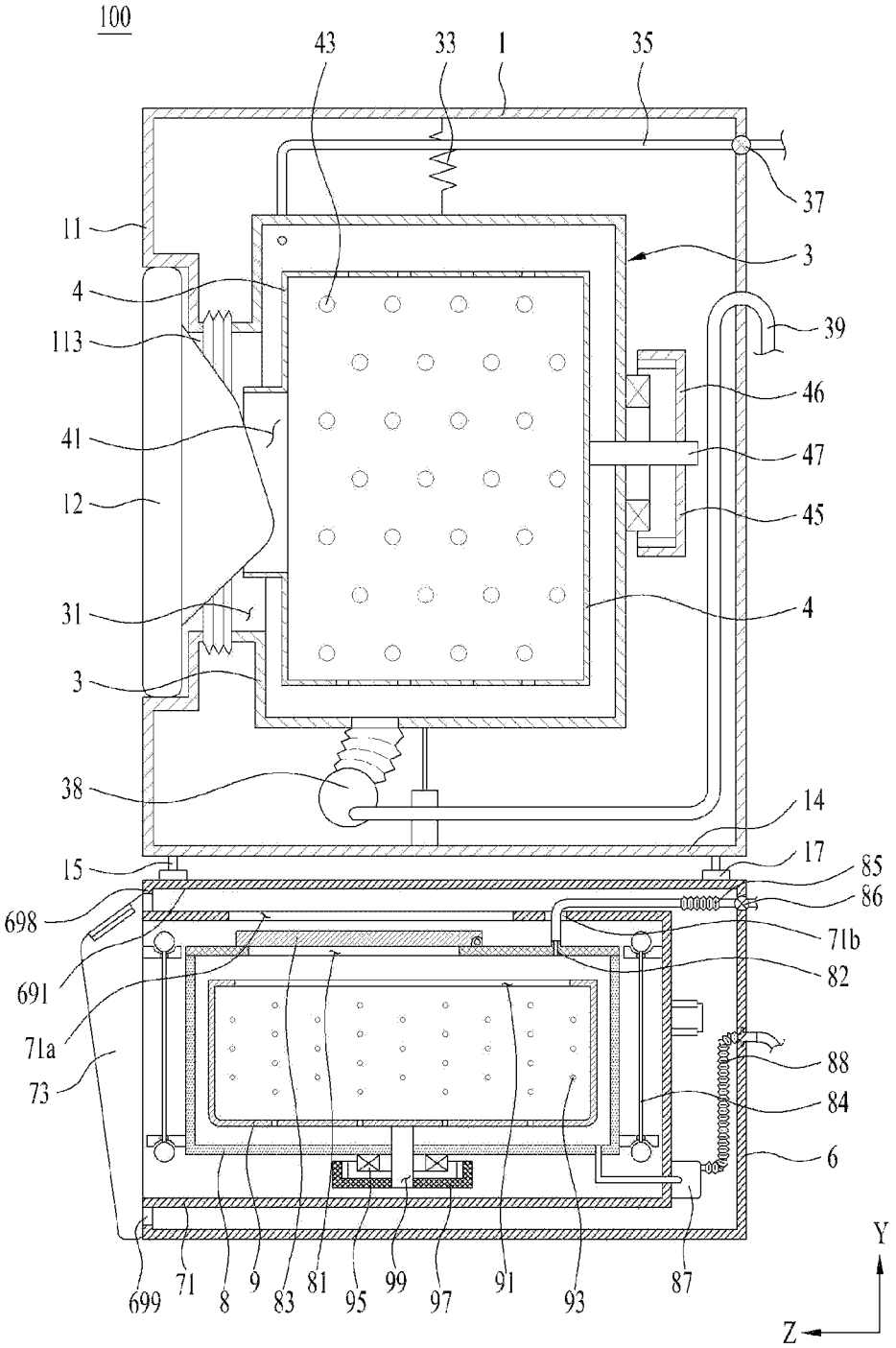

As shown in FIG. 2, an outlet 699 is provided on a front surface 698 of the first cabinet 6, and the drawer 7 includes a drawer body 71 drawn out from the first cabinet 6 through the outlet 699, and a drawer panel 73 fixed to the drawer body, opening or closing the outlet 699.

The drawer body 71 may be provided in a hexahedral shape, and a first drawer through hole 71*a* and a second drawer through hole 71*b* for communicating the inside of the drawer body 71 with the outside of the drawer body 71 may be provided on an upper surface of the drawer body 71. The first drawer through hole 71*a* is a means for supplying laundry to the first drum 9, and the second drawer through hole 71*b* is a means for supplying water to the first tub 8, and a detailed description of the first drawer through hole 71*a* and the second drawer through hole 71*b* will be described later.

The drawer panel 73 is fixed to a front surface of the drawer body 71 and located outside the first cabinet 6, and may be provided in a shape capable of opening or closing the outlet 699.

The case that the drawer panel 73 opens the outlet 699 means that the drawer panel 73 moves along a direction (+Z axis direction) far away from the front surface 698 of the first cabinet and therefore the outlet 699 is externally exposed. The case that the drawer panel 73 closes the outlet 699 means that the outlet 699 is covered with the drawer panel 73 and therefore is not externally exposed.

The drawer panel 73 may include a control panel 75 (first control panel). The first control panel 75 may be provided with an input unit for receiving a control command from a user, and a display unit for providing the user with information related to an operation of the first treating apparatus.

The first tub 8 may be provided in a hollow cylindrical shape and fixed into the drawer body 71 through a first tub support 84. An inlet 81 (first inlet) and a supply hole 82 are provided on an upper surface of the first tub 8. The first inlet 81 is preferably located below the first drawer through hole 71*a*, and the supply hole 82 may be located below the second drawer through hole 71*b*.

The first inlet 81 is opened or closed by a door 83 (first door), and the first door 83 may rotatably be fixed to the upper surface of the first tub 8 or may rotatably be fixed to the upper surface of the drawer body 71. FIG. 2 illustrates that the first door 83 is coupled to the upper surface of the first tub through a hinge as an example. In this case, the first door 83 should be provided in a shape that can be rotated toward a direction far away from the upper surface of the first tub 8 through the first through hole 71*a*.

The first tub 8 is supplied with water through a water supply (first water supply), and the water stored in the first tub 8 is discharged from the first tub through a drainage unit (first drainage unit).

The first water supply is provided to include a first water supply pipe 85 inserted into the second drawer through hole 71*b*, connecting a water supply source (not shown) with the supply hole 82, and a first valve 86 for opening or closing the first water supply pipe 85 by means of a first controller (not shown). The first drainage unit is provided to include a first drainage pipe 88 guiding the water in the first tub 8 to the outside of the first cabinet 6, and a first pump 87 allowing the water to move along the first drainage pipe 88.

Since the drawer body 71 is provided to move along a length direction (Z axis direction) of the first cabinet 6, the first water supply pipe 85 and the first drainage pipe 88 may be provided as pipes, each of which has an elastic length.

The first drum 9 is provided in a hollow cylindrical shape, and includes a first drum inlet 91 and a communication hole 93 on its upper surface, wherein the first drum inlet 91 is communicated with the first inlet 81, and the communication hole 93 is provided to pass through a circumferential surface and a bottom surface of the first drum. The first drum inlet 91 is located below the first inlet 81. Therefore, the user may supply laundry to the first drum 9 through the first drawer through hole 71*a*, the first inlet 81, and the first drum inlet 91.

The communication hole 93 is a means for communicating the inside of the first drum 9 with the first tub 8. Therefore, the water supplied to the first tub 8 is supplied to the laundry inside the first drum through the communication hole 93, and the water and particles remaining in laundry are discharged to the first tub 8 through the communication hole 93.

The first drum 9 is rotated through a first driver, and the first driver may be provided with a first stator 95, a first rotor 97, and a first rotary shaft 99. The first stator 95 is a means fixed to the bottom surface of the first tub 8, forming a rotating electric field, the first rotor 97 is a means rotated by the rotating electric field, and the first rotary shaft 99 is a means provided to pass through the bottom surface of the first tub, connecting the first drum 9 with the first rotor 97.

The second treating apparatus T includes a second cabinet 1 fixed to an upper surface of the first cabinet 6, a second inlet 113 provided on a front surface 11 of the second cabinet, a second door 12 opening or closing the second inlet, a second tub 3 provided inside the second cabinet to provide a space where the water is stored and communicated with the second inlet, and a second drum 4 rotatably provided inside the second tub to provide a space where laundry supplied through the second inlet is stored. If the second treating apparatus T is located on the first treating apparatus L, vibration and noise generated in the first treating apparatus L during rotation of the first drum 9 may be attenuated, and the height of the second inlet 113 may become high, whereby the user may conveniently insert or draw out laundry into or from the second treating apparatus T.

As shown in FIG. 1, the front surface 11 of the second cabinet means a surface toward the same direction as the front surface 698 of the first cabinet in the space provided by the second cabinet, and a second controller 111 may be provided on the front surface 11 of the second cabinet 1. The second controller 111 may include a second input unit for receiving a control command from a user, and a second display unit for displaying information related to an operation of the second treating apparatus.

The second treating apparatus T is fixed to the upper surface of the first cabinet 6 through a plurality of legs provided on a bottom surface 14 of the second cabinet. That is, the legs are means for supporting the second treating apparatus T, and may be provided at each corner of the bottom surface 14. FIG. 1 illustrates that the legs are provided as a first front leg 15, a second front leg 16, a first rear leg 17 (see FIG. 2), and a second rear leg 18, as an example.

The second tub 3 may be provided in a hollow cylindrical shape, and a second tub inlet 31 may be provided on a front surface of the second tub 3. The second tub inlet 31 may be connected to the second inlet 113 through a corrugated type gasket.

The second tub 3 is fixed into the second cabinet 1 through a second tub support 33, and the second tub support 33 may be provided with a damper for fixing a lower area of the second tub to the bottom surface 14 of the second cabinet, and a spring for fixing an upper area of the second tub to the second cabinet.

The second tub is supplied with water through the second water supply, and discharges the water stored in the second tub to the outside of the second cabinet. The second water supply may be provided to include a second water supply pipe 35 connecting the water supply source with the second tub 3, and a second valve 37 for opening or closing the second water supply pipe 35 in accordance with a control signal of a second controller (not shown). The second drainage unit may be provided to include a second drainage pipe 39 guiding the water in the second tub 3 to the outside of the second cabinet 1, and a second pump 38 allowing the water to move along the second drainage pipe 39.

The second drum 4 may be provided in a hollow cylindrical shape, and may include a second drum inlet 41 on its front surface, wherein the second drum inlet 41 is communicated with the second tub inlet 31. A plurality of communication holes 43 may be provided on a front surface, a circumferential surface and a rear surface of the second drum 4.

The second drum 4 is rotated through a second driver, and the second driver may be provided to include a second stator 45 fixed to a rear surface of the second tub 3, forming a rotating field, a second rotor 46 rotated by the rotating field, and a second rotary shaft 47 provided to pass through the rear surface of the second tub 3, connecting the second drum 4 with the second rotor 46.

Figure 3:
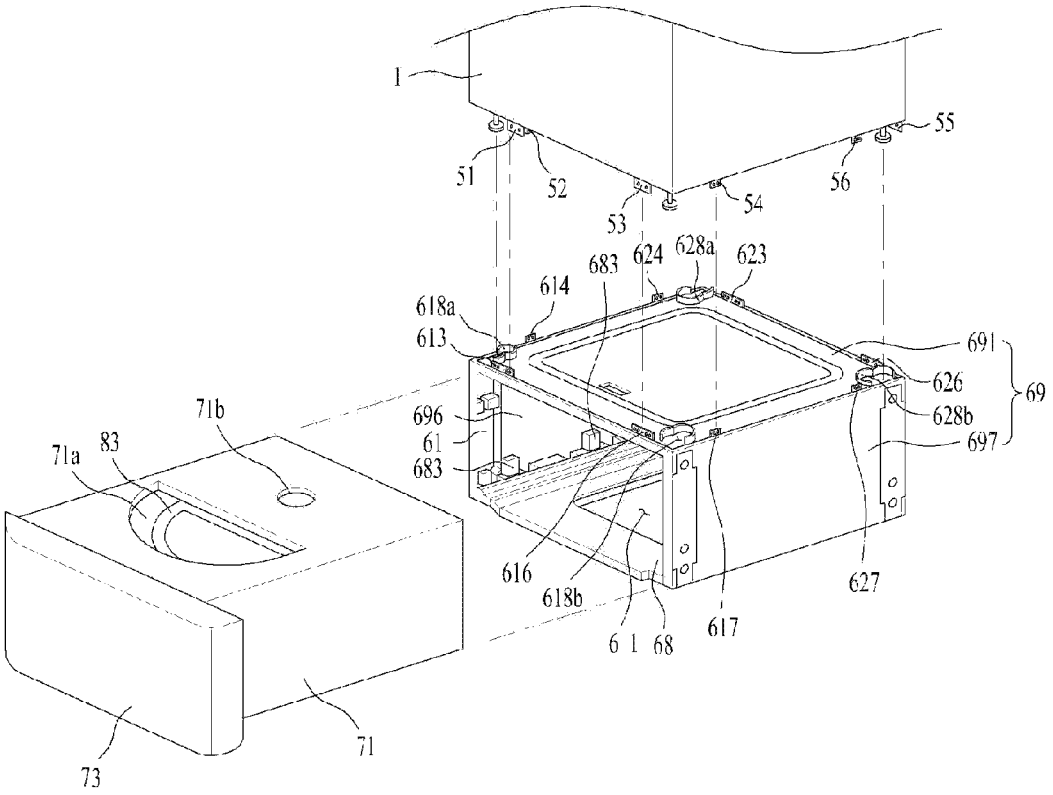
FIGS. 3 and 4 illustrate examples of a first cabinet provided in a laundry treating apparatus.

The second treating apparatus T may further include a joint unit for fixing the second cabinet 1 to the first treating apparatus L. FIG. 3 illustrates that the joint unit includes a first front joint plate 51, a second front joint plate 53, a first rear joint plate (not shown), a second rear joint plate 55, a first left joint plate 52, a first right joint plate 54, a second left joint plate (not shown), and a second right joint plate 56, as an example.

The first front joint plate 51 and the second front joint plate 53 may be provided to be protruded from the bottom surface 14 of the second cabinet to be parallel with the front surface 11 of the second cabinet, and the first rear joint plate and the second rear joint plate 55 may be provided to be protruded from the bottom surface 14 of the second cabinet to be parallel with the rear surface of the second cabinet.

The first left joint plate 52 and the second left joint plate may be provided to be protruded from the bottom surface 14 of the second cabinet to be parallel with the left side of the second cabinet, and the first right joint plate 54 and the second right joint plate 56 may be provided to be protruded from the bottom surface 14 of the second cabinet to be parallel with the right side of the second cabinet.

As shown in FIG. 3, the joint unit may be provided to include only the first front joint plate 51, the second front joint plate 53, the first rear joint plate (not shown), and the second rear joint plate 55, or may be provided to include only the first left joint plate 52, the first right joint plate 54, the second left joint plate (not shown), and the second right joint plate 56.

Figure 4:
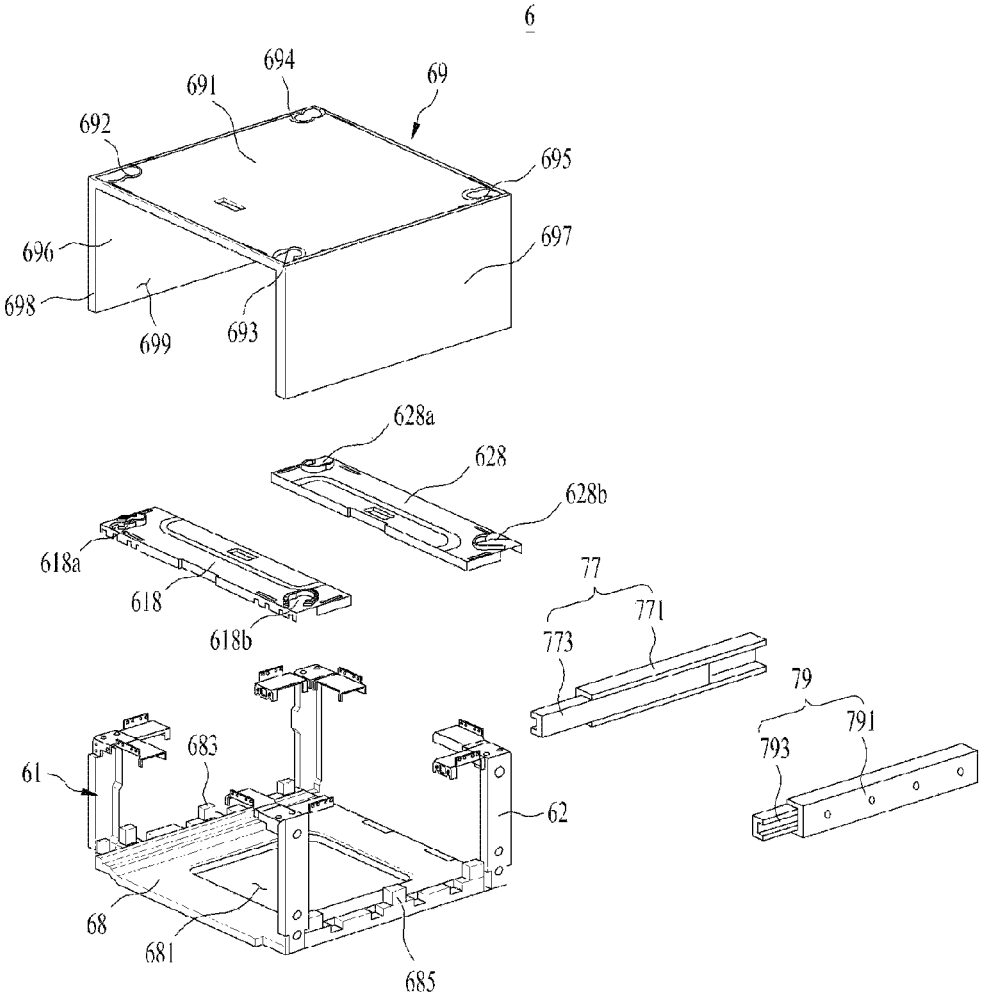

As shown in FIG. 4, the first cabinet 6 provided in the first treating apparatus includes first and second frames 61 and 62 spaced apart from each other along a moving direction (Z axis direction) of the drawer 7, a base panel 68 fixed to the first and second frames, forming the bottom surface of the first cabinet 6, and a cover 69 fixed to the first and second frames, forming the upper surface of the first cabinet 6 and both sides of the first cabinet 6.

The base panel 68 may be made of a material lighter than the frames 61 and 62 or a material lighter than the cover 69. That is, if the frames 61 and 62 and the cover 69 are made of a metal material, the base panel 68 may be made of plastic. This is to minimize a weight of the first cabinet 6 and reduce the manufacturing cost.

The base panel 68 includes a first slide 77 providing a moving path of the drawer 7, and first and second supports 683 and 685 to which first and second slides 77 and 79 are respectively fixed.

The first support 683 and the second support 685 are provided in the base panel 68 along a direction where the drawer body 71 is drawn out, and an interval between the first support 683 and the second support 685 should be set to be longer than a width (X axis direction length of the drawer body) of the drawer body 71. Considering minimization of the manufacturing cost and easiness of assembly, the base panel 68, the first support 683 and the second support 685 may be provided in one body. The case that the base panel 68, the first support 683 and the second support 685 are provided in one body means that the first support 683 and the second support 685 are fixed to the base panel 68 through a manufacturing method such as injection molding without a joint member.

The first slide 77 may include a first fixed body 771 fixed to the first support 683, and a first detachable body 773 having one end fixed to the drawer body 71 and the other end detachably coupled to the first fixed body 771. Likewise, the second slide 79 may include a second fixed body 791 fixed to the second support 685, and a second detachable body 793 having one end fixed to the drawer body 71 and the other end detachably coupled to the second fixed body 791. The first fixed body 771 and the second fixed body 791 may respectively be fixed to the first support 683 and the second support 685 by a joint means such as a bolt.

Meanwhile, a panel through hole 681 may be provided in the base panel 68, and may be a means for allowing the external air for cooling of the first driver to enter the inside of the first cabinet 6.

The cover 69 includes an upper panel 691 forming the upper surface of the first cabinet 6, a first side panel 696 forming the left side of the first cabinet, and a second side panel 697 forming the right side of the first cabinet. The upper panel 691, the first side panel 696 and the second side panel 697 may be provided in such a manner that both ends of one metal plate are downwardly bent. In this case, the outlet 699 formed on the front surface 698 of the first cabinet 6 is formed by the cover 69 and the base panel 68.

Although not shown, the laundry treating apparatus may further include a rear panel forming the rear surface of the first cabinet 6. Preferably, the rear panel is detachably coupled to the rear of the cover 69 or the second frame 62. Since the first water supply, the first drainage are located in a rear area of the first cabinet 6, if the rear panel is detachably provided at the rear of the second frame 62 or the cover 69, it will be easy to check and repair the first water supply or the first drainage.

The first frame 61 and the second frame 62 are means for supporting the cover 69 and the base panel 68.

Figure 5:
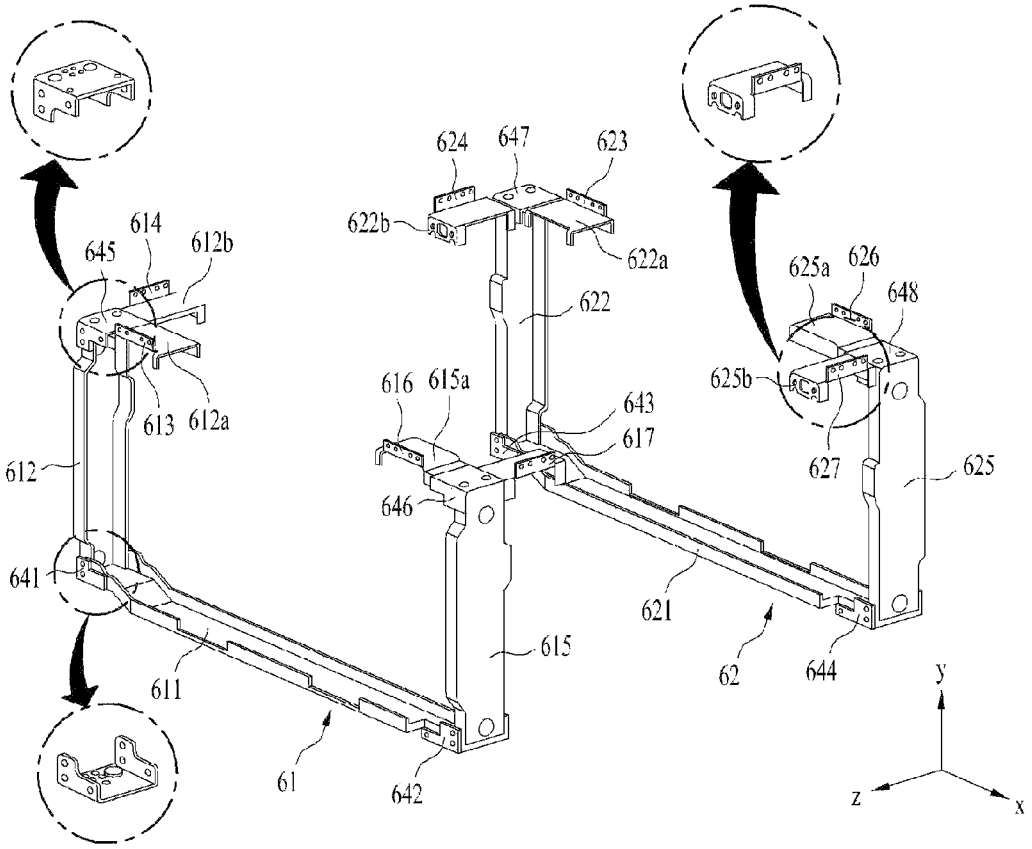
FIG. 5 illustrates an example of a first frame and a second frame.

As shown in FIG. 5, the first frame 61 may include a first frame body 611 of a bar shape provided to form the bottom surface of the first frame 61 to allow the bottom surface of the base panel 68 to be fixed thereto, a first frame first side body 612 extended from one end of the first frame body 611 along a height direction (Y axis direction) of the drawer, a first frame second side body 615 extended from the other end of the first frame body 611 along a height direction of the drawer, and a first frame upper body 618 (see FIG. 4) connecting the first frame first side boy 612 with the first frame second side body 615.

The first frame body 611, the first frame first side body 612, and the first frame second side body 615 may be provided in such a manner that one metal is bent in a U shape through press molding.

As shown in FIG. 4, the first frame upper body 618 is provided to form the upper surface of the first frame 61, and provides a space where the upper panel 691 is fixed. Also, an interval between a free end of the first frame first side body 612 and a free end of the first frame second side body 615 is maintained (strength of the first frame is reinforced). The first frame upper body 618 may be made of a material lighter than the first frame body 611, for example, plastic. If the first frame upper body 618 is made of a material lighter than metal, a weight and manufacturing cost of the first cabinet 6 may be minimized.

A first outlet communication hole communicated with the outlet 699 should be provided in the first frame 61 such that the drawer body 71 may pass through the first frame 61. The first outlet communication hole is formed by the first frame body 611, the first frame first side body 612, the first frame second side body 615, and the first frame upper body 618.

A first front leg accommodating unit 618*a* providing a space in which the first front leg 15 provided in the second treating apparatus is accommodated and a second front leg accommodating unit 618*b* providing a space in which the second front leg 16 provided in the second treating apparatus is accommodated are provided in the first frame upper body 618.

The first front leg accommodating unit 618*a* is protruded from the first frame upper body 618 to form a space in which the first front leg 15 is accommodated, and the second front leg accommodating unit 618*b* is protruded from the first frame upper body 618 to form a space in which the second front leg 16 is accommodated.

The first front leg accommodating unit 618*a* is exposed to the upper surface of the first cabinet 6 through a first upper through hole 692 provided to pass through the upper panel 691, and the second front leg accommodating unit 618*b* is exposed to the outside of the first cabinet 6 through a second upper through hole 693 provided to pass through the upper panel 691.

As shown in FIG. 5, the second frame 62 includes a second frame body 621 of a bar shape provided to form the bottom surface of the second frame 62, supporting the bottom surface of the base panel 68, a second frame first side body 622 extended from one end of the second frame body 621 along a height direction (Y axis direction) of the drawer, a second frame second side body 625 extended from the other end of the second frame body 621 along a height direction of the drawer, and a second frame upper body 628 forming the upper surface of the second frame 62.

The second frame body 621, the second frame first side body 622, and the second frame second side body 625 may be provided in such a manner that one metal is bent in a U shape through press molding. The second frame upper body 628 may be made of a plastic material.

As shown in FIG. 4, the second frame upper body 628 is provided to connect the second frame first side body 622 with the second frame second side body 625 and provides a space where the upper panel 691 is fixed.

A second outlet communication hole communicated with the outlet 699 should be provided in the second frame 62. The second outlet communication hole is formed by the second frame body 621, the second frame first side body 622, the second frame second side body 625, and the second frame upper body 628.

A first rear leg accommodating unit 628*a* providing a space in which the first rear leg 17 provided in the second treating apparatus is accommodated and a second rear leg accommodating unit 628*b* providing a space in which the second rear leg 18 provided in the second treating apparatus is accommodated are provided in the second frame upper body 628.

The first rear leg accommodating unit 628*a* is protruded from the second frame upper body 628 to form a space in which the first rear leg 17 is accommodated, and the second rear leg accommodating unit 628*b* is protruded from the second frame upper body 628 to form a space in which the second rear leg 18 is accommodated.

The first rear leg accommodating unit 628*a* is exposed to the upper surface of the first cabinet 6 through a third upper through hole 694 provided to pass through the upper panel 691, and the second rear leg accommodating unit 628*b* is exposed to the outside of the first cabinet 6 through a fourth upper through hole 695 provided to pass through the upper panel 691.

Since the first front leg accommodating unit 618*a* and the second front leg accommodating unit 618*b* are provided in the first frame upper body 618 and the first rear leg accommodating unit 628*a* and the second rear leg accommodating unit 628*b* are provided in the second frame upper body 628, the laundry treating apparatus needs to assemble separate leg accommodating units in the upper panel 691 after fixing the cover 60 to the frames 61 and 62.

It is assumed that the first front leg accommodating unit 618*a* and the second front leg accommodating unit 618*b* are provided to detached from the first frame upper body 618 and the first rear leg accommodating unit 628*a* and the second rear leg accommodating unit 628*b* are provided to be detached from the second frame upper body 628. In this case, a worker should assemble the first front leg accommodating unit 618*a*, the second front leg accommodating unit 618*b*, the first rear leg accommodating unit 628*a* and the second rear leg accommodating unit 628*b* in each corner of the upper panel 691 by using a bolt, etc. after assembling the cover 69 in the two frames 61 and 62. This causes problems in increasing a working time and components. Therefore, it is advantageous that the structures of the first frame upper body 618 and the second frame upper body 628 reduce the working time and minimize the number of components.

As shown in FIG. 5, in order to enhance strength of the cabinet 6, the laundry treating apparatus 100 may further include a first bracket 641 having one end fixed to the first frame body 611 and the other end fixed to the first frame first side body 612, a second bracket 642 having one end fixed to the first frame body 611 and the other end fixed to the first frame second side body 615, a third bracket 643 having one end fixed to the second frame body 621 and the other end fixed to the second frame first side body 622, and a fourth bracket 644 having one end fixed to the second frame body 621 and the other end fixed to the second frame second side body 625.

Moreover, in order to enhance strength of the first cabinet 6 by stably supporting the first frame upper body 618 and the second frame upper body 628, the first frame 61 may further include a first front extension body 612*a*, a second front extension body 615*a*, a first rear extension body 622*a*, and a second rear extension body 625*a*.

The first front extension body 612*a* may be made of a metal plate extended from the first frame first side body 612 to the first frame second side body 615, and the second front extension body 615*a* may be made of a metal plate extended from the first frame second side body 615 to the first frame first side body 612.

Likewise, the first rear extension body 622*a* may be made of a metal plate extended from the second frame first side body 622 to the second frame second side body 625, and the second rear extension body 625*a* may be made of a metal plate extended from the second frame second side body 625 to the second frame first side body 622.

The first frame body 611, the first frame first side body 612, the first frame second side body 615, the first front extension body 612*a*, and the second front extension body 615*a* may be provided in such a manner that one metal is bent in a U shape through press molding. In this case, the first frame first side body 612 may be connected with the first front extension body 612*a* through a first upper bracket 645, and the first frame second side body 615 may be connected with the second front extension body 615*a* through a second upper bracket 646.

One end of the first upper bracket 645 may be fixed to the first frame first side body 612 through a joint means such as a bolt, and the other end of the first upper bracket 645 may be fixed to the first front extension body 612*a* through a joint means such as a bolt. Likewise, one end of the second upper bracket 646 may be fixed to the first frame second side body 615 through a joint means such as a bolt, and the other end of the second upper bracket 646 may be fixed to the second front extension body 615*a* through a joint means such as a bolt.

The second frame body 621, the second frame first side body 622, the second frame second side body 625, the first rear extension body 622*a*, and the second rear extension body 625*a* may be provided in such a manner that one metal is bent in a U shape through press molding. In this case, the second frame first side body 622 may be connected with the first rear extension body 622*a* through a third upper bracket 647, and the second frame second side body 625 may be connected with the second rear extension body 625*a* through a fourth upper bracket 648. The first upper bracket 645, the second upper bracket 646, the third upper bracket 647 and the fourth upper bracket 648 may be made of a metal material.

The first front extension body 612*a* may be provided with a first front connection plate 613 to which a first front joint plate 51 of the second treating apparatus T is fixed through the upper panel 691 of the first cabinet and the first frame upper body 618, and the second front extension body 615*a* may be provided with a second front connection plate 616 to which a second front joint plate 53 of the second treating apparatus T is fixed through the upper panel 691 of the first cabinet and the first frame upper body 618.

The first front connection plate 613 may be made of a metal plate projected from the first front extension body 612*a* toward the upper panel 691 of the first cabinet (projected toward a height direction of the first cabinet). Preferably, the first front extension body 612*a* and the first front connection plate 613 are provided in one body.

Likewise, the second front connection plate 616 may be made of a metal plate projected from the second front extension body 615*a* toward the upper panel 691 of the first cabinet. Preferably, the second front extension body 615*a* and the second front connection plate 616 are provided in one body.

Figure 6:
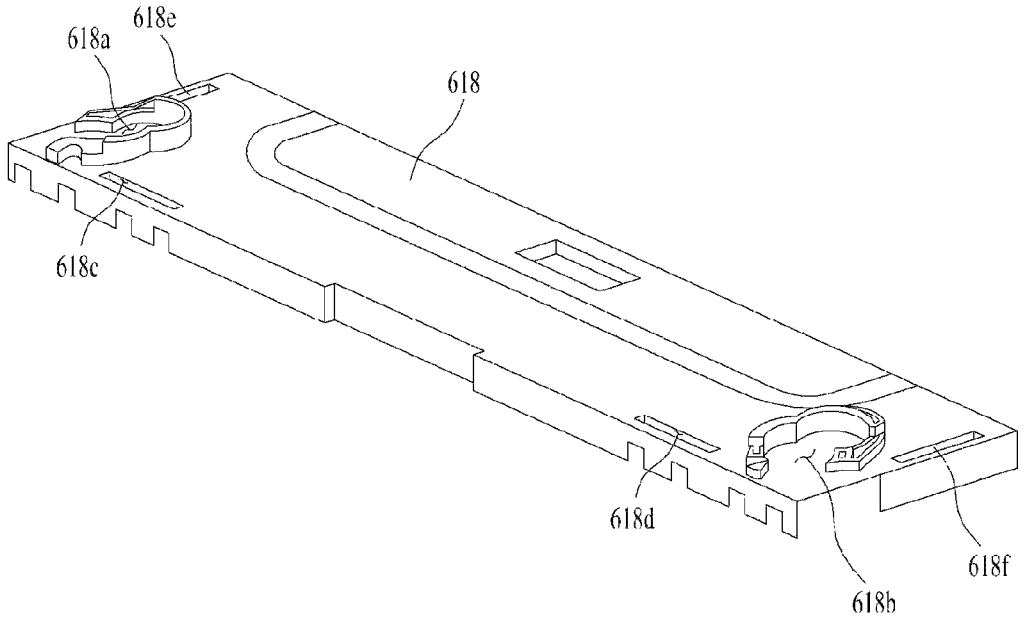
FIG. 6 illustrates an example of a first frame upper body.

As shown in FIG. 6, the first frame upper body 618 should be provided with a first front connection plate through hole 618*c* and a second front connection plate through hole 618*d* through which the first front connection plate 613 and the second front connection plate 616 pass, and the upper panel 691 should be provided with a first front connection plate cabinet through hole (not shown) and a second front connection plate cabinet through hole (not shown).

As shown in FIG. 5, the first rear extension body 622*a* may be provided with a first rear connection plate 623 to which the first rear joint plate of the second treating apparatus is fixed through the upper panel 691 of the first cabinet and the second frame upper body 628, and the second rear extension body 625*a* may be provided with a second rear connection plate 626 to which the second rear joint plate 55 of the second treating apparatus T is fixed through the upper panel 691 and the second frame upper body 628.

Figure 7:
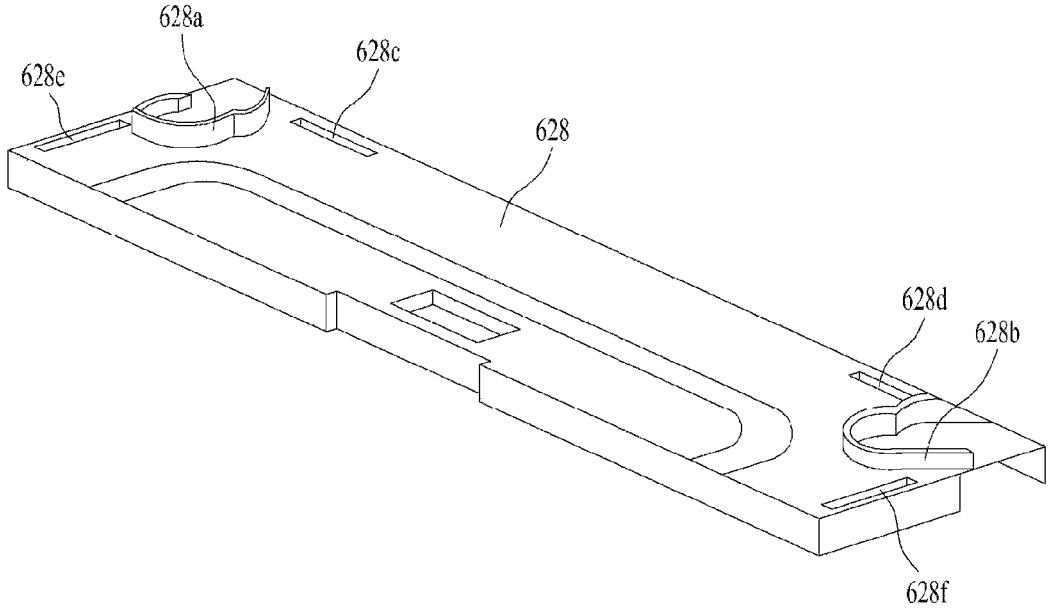
FIG. 7 illustrates an example of a second frame upper body.

As shown in FIG. 7, the second frame upper body 628 should be provided with a first rear connection plate through hole 628*c* and a second rear connection plate through hole 628*d* through which the first rear connection plate 623 and the second rear connection plate 626 pass, and the upper panel 691 should be provided with a first rear connection plate cabinet through hole (not shown) and a second rear connection plate cabinet through hole (not shown).

In order to enhance strength of the first cabinet 6 along a length direction (Z axis direction), the first frame 61 may further include a third front extension body 612*b*, a fourth front extension body 643, a third rear extension body 622*b*, and a fourth rear extension body 625*b*.

The third front extension body 612*b* may be made of a metal plate extended from the first frame first side body 612 to the second frame first side body 622, and the fourth front extension body 615*b* may be made of a metal plate extended from the first frame second side body 615 to the second frame second side body 625. The third front extension body 612*b* may be fixed to the first frame first side body 612 through a bolt, and the fourth front extension body 615*b* may be fixed to the first frame second side body 615 through a bolt.

The third rear extension body 622*b* may be made of a metal plate extended from the second frame first side body 622 to the first frame first side body 612, and the fourth rear extension body 625*b* may be made of a metal plate extended from the second frame second side body 625 to the first frame second side body 615. The third rear extension body 622*b* may be fixed to the second frame first side body 622 through a bolt, and the fourth rear extension body 625*b* may be fixed to the second frame second side body 625 through a bolt.

The third front extension body 612*b* is provided with a first left connection plate 614 to which the first left joint plate 52 of the second treating apparatus T is fixed through the upper panel 691 of the first cabinet and the first frame upper body 618, and the fourth front extension body 615*b* is provided with a first right connection plate 617 to which the first right joint plate 54 of the second treating apparatus T is fixed through the upper panel 691 and the first frame upper body 618.

As shown in FIG. 6, the first frame upper body 618 should be provided with a first left connection plate through hole 618*e* and a first right connection plate through hole 618*f* through which the first left connection plate 614 and the first right connection plate 617 pass, and the upper panel 691 should be provided with a first left connection plate cabinet through hole (not shown) and a second right connection plate cabinet through hole (not shown).

Meanwhile, the third rear extension body 622*b* is provided with a second left connection plate 624 to which the second left joint plate (not shown) of the second treating apparatus T is fixed through the upper panel 691 and the second frame upper body 628, and the fourth rear extension body 625*b* is provided with a second right connection plate 627 to which the second right joint plate 54 of the second treating apparatus T is fixed through the upper panel 691 and the second frame upper body 628.

As shown in FIG. 7, the second frame upper body 628 should be provided with a second left connection plate through hole 628*e* and a second right connection plate through hole 628*f* through which the second left connection plate 624 and the second right connection plate 627 pass, and the upper panel 691 should be provided with a second left connection plate cabinet through hole (not shown) and a second right connection plate cabinet through hole (not shown).

The first frame upper body 618 and the second frame upper body 628 may be provided in the same structure. In this case, the first frame upper body 618 may be the second frame upper body if rotated at 180°.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A laundry treating apparatus comprising:

a cabinet provided with an outlet;

a drawer drawn out from the cabinet through the outlet;

a tub provided inside the drawer to provide a space in which water is stored, having an inlet on an upper surface of the tub;

a door provided on an upper surface of the drawer or the upper surface of the tub, opening or closing the inlet;

a drum rotatably provided inside the tub, storing laundry therein; and a drum inlet provided on an upper surface of the drum, allowing laundry supplied to the inlet to enter the inside of the drum, wherein the cabinet includes:

a first frame provided with a first outlet communication hole communicated with the outlet, at least a part of the first frame being made of a metal material;

a second frame provided to be spaced apart from the first frame along a moving direction of the drawer, having a second outlet communication hole communicated with the outlet, at least a part of the second frame being made of a metal material;

a base panel fixed to the first frame and the second frame, forming a bottom surface of the cabinet, and made of a nonmetal material lighter than metal; and a cover fixed to the first frame and the second frame, forming an upper surface and two lateral sides of the cabinet, and made of a metal material.

2. The laundry treating apparatus of claim 1, wherein the base panel is made of a plastic material.

3. The laundry treating apparatus of claim 1, further comprising:

a first support and a second support in the base panel along a direction where the drawer is drawn out and spaced apart from each other at an interval longer than a width of the drawer;

a first fixed body fixed to the first support;

a first detachable body having one end fixed to the drawer and another end detachably coupled to the first fixed body;

a second fixed body fixed to the second support; and a second detachable body having one end fixed to the drawer and another end detachably coupled to the second fixed body.

4. The laundry treating apparatus of claim 3, wherein the base panel, the first support and the second support are provided in one body through injection molding.

5. The laundry treating apparatus of claim 3, further comprising:

a stator provided on a bottom surface of the tub, generating a rotating field;

a rotor rotated by the rotating field;

a rotary shaft provided to pass through the bottom surface of the tub, connecting the rotor with a bottom surface of the drum; and a panel through hole provided to pass through the base panel, allowing the air to the inside of the cabinet.

6. The laundry treating apparatus of claim 1, wherein the first frame includes:

a first frame body of a bar shape provided to form a bottom surface of the first frame, supporting a lower surface of the base panel, and made of a metal material;

a first frame first side body of a metal material extended from one end of the first frame body along a height direction of the drawer;

a first frame second side body of a metal material extended from another end of the first frame body along the height direction of the drawer; and a first frame upper body provided to connect the first frame first side body with the first frame second side body, forming an upper surface of the first frame, and made of a nonmetal material lighter than metal, and wherein the second frame includes:

a second frame body of a bar shape provided to form a bottom surface of the second frame, supporting the lower surface of the base panel, and made of a metal material;

a second frame first side body of a metal material extended from one end of the second frame body along the height direction of the drawer;

a second frame second side body of a metal material extended from another end of the second frame body along the height direction of the drawer; and a second frame upper body provided to connect the second frame first side body with the second frame second side body, forming an upper surface of the second frame, and made of a nonmetal material.

7. The laundry treating apparatus of claim 6, wherein the first frame upper body and the second frame upper body are made of a plastic material.

8. The laundry treating apparatus of claim 6, wherein the first frame body, the first frame first side body and the first frame second side body are provided such that one metal is bent in a U shape through press molding, and the second frame body, the second frame first side body and the second frame second side body are provided such that one metal is bent in a U shape through press molding.

9. The laundry treating apparatus of claim 8, further comprising:

a first bracket having one end fixed to the first frame body and another end fixed to the first frame first side body;

a second bracket having one end fixed to the first frame body and another end fixed to the first frame second side body;

a third bracket having one end fixed to the second frame body and another end fixed to the second frame first side body; and a fourth bracket having one end fixed to the second frame body and another end fixed to the second frame second side body.

10. The laundry treating apparatus of claim 6, wherein the cabinet is a first cabinet, and further comprising:

a second cabinet located on the first cabinet;

a second drum rotatably provided inside the second cabinet, providing a space in which laundry is stored;

a first front leg and a second front leg provided to correspond to the first frame upper body in a space provided by a bottom surface of the second cabinet;

a first rear leg and a second rear leg provided to correspond to the second frame upper body in the space provided by the bottom surface of the second cabinet;

a first front leg accommodating unit provided in the first frame upper body to pass through the upper surface of the first cabinet, providing a space in which the first front leg is accommodated;

a second front leg accommodating unit provided in the first frame upper body to pass through the upper surface of the first cabinet, providing a space in which the second front leg is accommodated;

a first rear leg accommodating unit provided in the second frame upper body to pass through the upper surface of the first cabinet, providing a space in which the first rear leg is accommodated; and a second rear leg accommodating unit provided in the second frame upper body to pass through the upper surface of the first cabinet, providing a space in which the second rear leg is accommodated.

11. The laundry treating apparatus of claim 10, further comprising:

a first front extension body extended from the first frame first side body toward the first frame second side body;

a second front extension body extended from the first frame second side body toward the first frame first side body;

a first rear extension body extended from the second frame first side body toward the second frame second side body;

a second rear extension body extended from the second frame second side body toward the second frame first side body;

a first front connection plate provided in the first front extension body and provided to pass through the first frame upper body and the upper surface of the first cabinet;

a second front connection plate provided in the second front extension body and provided to pass through the first frame upper body and the upper surface of the first cabinet;

a first rear connection plate provided in the first rear extension body and provided to pass through the second frame upper body and the upper surface of the first cabinet;

a first front joint plate provided on the bottom surface of the second cabinet and jointed to the first front connection plate;

a second front joint plate provided on the bottom surface of the second cabinet and jointed to the second front connection plate;

a first rear joint plate provided on the bottom surface of the second cabinet and jointed to the first rear connection plate; and a second rear joint plate provided on the bottom surface of the second cabinet and jointed to the second rear connection plate.

12. The laundry treating apparatus of claim 11, wherein the first frame body, the first frame first side body, the first frame second side body, the first front extension body, and the second front extension body are provided such that one metal is bent in a U shape through press molding, and the second frame body, the second frame first side body, the second frame second side body, the first rear extension body, and the second rear extension body are provided such that one metal is bent in a U shape through press molding.

13. The laundry treating apparatus of claim 12, further comprising:

a first upper bracket having one end fixed to the first frame first side body and another end fixed to the first front extension body;

a second upper bracket having one end fixed to the first frame second side body and another end fixed to the second front extension body;

a third upper bracket having one end fixed to the second frame first side body and another end fixed to the first rear extension body; and a fourth upper bracket having one end fixed to the second frame second side body and another end fixed to the second rear extension body.

14. The laundry treating apparatus of claim 10, further comprising:

a third front extension body extended from the first frame first side body toward the second frame first side body;

a fourth front extension body extended from the first frame second side body toward the second frame second side body;

a third rear extension body extended from the second frame first side body toward the first frame first side body;

a fourth rear extension body extended from the second frame second side body toward the first frame second side body;

a first left connection plate provided in the third front extension body and provided to pass through the first frame upper body and the upper surface of the first cabinet;

a first right connection plate provided in the fourth front extension body and provided to pass through the first frame upper body and the upper surface of the first cabinet;

a second left connection plate provided in the third rear extension body and provided to pass through the second frame upper body and the upper surface of the first cabinet;

a second right connection plate provided in the fourth rear extension body and provided to pass through the second frame upper body and the upper surface of the first cabinet;

a first left joint plate provided on the bottom surface of the second cabinet and jointed to the first left connection plate;

a first right joint plate provided on the bottom surface of the second cabinet and jointed to the first right connection plate;

a second left joint plate provided on the bottom surface of the second cabinet and jointed to the second left connection plate; and a second right joint plate provided on the bottom surface of the second cabinet and jointed to the second right connection plate.

* * * * *